US006429577B1

(12) United States Patent
Kiryu et al.

(10) Patent No.: US 6,429,577 B1
(45) Date of Patent: Aug. 6, 2002

(54) DISCHARGE LAMP WITH OUTER TUBE COMPRISING SILICON DIOXIDE AND BORON

(75) Inventors: Hideaki Kiryu; Kazuhisa Tanaka, both of Osaka; Takeshi Saitoh, Hyogo, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/326,951

(22) Filed: Jun. 7, 1999

(30) Foreign Application Priority Data

Jun. 12, 1998 (JP) ..... 10-164922
Nov. 20, 1998 (JP) ..... 10-330646

(51) Int. Cl.[7] ..... H01J 1/02; H01J 61/52; H01J 7/24; H01J 1/58

(52) U.S. Cl. ..... 313/25; 313/573; 313/636; 501/54; 501/64; 501/65

(58) Field of Search ..... 313/25, 570, 571, 313/573, 636, 635; 501/54, 64, 65

(56) References Cited

U.S. PATENT DOCUMENTS 4,949,003 A * 8/1990 Cox et al. ..... 313/25
5,159,239 A 10/1992 Eklkelboom et al. ..... 313/623
5,196,759 A 3/1993 Parham et al. ..... 313/112
5,391,523 A 2/1995 Marlor ..... 501/14
5,528,107 A * 6/1996 Marlor et al. ..... 313/636
5,532,195 A 7/1996 Weiss et al. ..... 501/54
5,541,471 A 7/1996 Terheijden et al. ..... 313/112
5,552,665 A * 9/1996 Trushell ..... 313/489
5,569,979 A 10/1996 Scott et al. ..... 313/636
5,594,294 A * 1/1997 Duffy et al. ..... 313/25
5,619,102 A * 4/1997 Scholler ..... 313/635
5,631,522 A 5/1997 Scott et al. ..... 313/636
5,680,010 A 10/1997 Weiss et al. ..... 313/636
5,719,463 A * 2/1998 Hassink et al. ..... 313/25

FOREIGN PATENT DOCUMENTS

EP 0 601 391 A1 6/1994
EP 0 616 358 A1 9/1994

* cited by examiner

*Primary Examiner*—Vip Patel
*Assistant Examiner*—Kevin Quarterman
(74) *Attorney, Agent, or Firm*—Merchant & Gould PC

(57) ABSTRACT

A discharge lamp comprising an arc tube containing a pair of electrodes in a light-emitting portion and an outer tube that envelops the light-emitting portion and is at least partly fused to the arc tube, wherein the outer tube comprises silicon dioxide in the range from 90 to 99.88 wt. % and boron in the range from 0.12 wt. % or more. The discharge lamp can inhibit the arc tube from deforming when the outer tube and arc tube are fused to each other by adjusting a softening temperature of the outer tube to an appropriate temperature and can realize a high accuracy of luminous intensity distribution.

24 Claims, 1 Drawing Sheet

DISCHARGE LAMP WITH OUTER TUBE COMPRISING SILICON DIOXIDE AND BORON

FIELD OF THE INVENTION

The present invention relates to a discharge lamp used for an automobile headlight, a light source for the backlight of a liquid crystal projector or the like.

BACKGROUND OF THE INVENTION

A discharge lamp is provided with an arc tube having a pair of electrodes in a gas and uses light emitted by an arc discharge generated in the arc tube. In this discharge lamp, light emitted from the arc tube includes ultraviolet rays. Therefore, there was a problem in that the ultraviolet rays deteriorate the quality of various components such as a reflecting mirror, a front glass, etc., which are located in the vicinity of the discharge lamp. In order to eliminate such a problem, a discharge lamp in which an arc tube is enveloped by an outer tube containing additives capable of absorbing ultraviolet rays has been suggested. This discharge lamp is produced by inserting the arc tube into the outer tube and then fusing the end portion of the outer tube to the arc tube.

However, in the above-mentioned discharge lamp, both the outer tube and the arc tube are made of silica glass. Since the softening temperature of the outer tube is high and the same level as that of the arc tube, when the outer tube is fused to the arc tube, the arc tube also may be softened and deformed. The softening of the arc tube causes the electrodes located in the arc tube to deviate from the appropriate location, and, in turn, an arc generated between the electrodes to deviate, which may result in deteriorating the accuracy of luminous intensity distribution of the discharge lamp.

SUMMARY OF THE INVENTION

It is an object of the present invention to provide a discharge lamp achieving a high accuracy of luminous intensity distribution by inhibiting the deformation of the arc tube.

In order to achieve the above-mentioned object, a first discharge lamp of the present invention comprises an arc tube having a light-emitting portion provided with a pair of electrodes and an outer tube enveloping the light-emitting portion and at least partly fused to the arc tube. Herein, the outer tube contains silicon dioxide as a main component and further contains boron. With such a structure, the softening temperature of the outer tube can be made sufficiently lower than that of the arc tube. Thus, when the arc tube and outer tube are fused to each other, the deformation of the arc tube can be inhibited.

It is preferable in the first discharge lamp that the outer tube contains 0.12 weight % (referred to as wt. % hereinafter) or more of boron. Thus, the softening temperature of the outer tube can be adjusted to a more preferable temperature.

Furthermore, it is preferable in the first discharge lamp that the expression: $w_B/D \leqq 120$ is satisfied, wherein $w_B$[wt. % ] is the content of boron in the outer tube and D [mm] is the shortest distance between the inner surface of the outer tube and the external surface of the light-emitting portion. Thus, the softening temperature of the outer tube is inhibited from becoming excessively low. Furthermore, the outer tube is inhibited from deforming with the passage of the lighting time of the discharge lamp.

Still furthermore, it is preferable in the first discharge lamp that the expression: $w_B/L<1.2$ is satisfied, wherein $w_B$[wt. %] is the content of boron in the outer tube and L [mm] is the shortest distance between the tip of the electrode located in the light-emitting portion and the portion where the outer tube and the arc tube are fused to each other. Thus, the softening temperature of the outer tube is inhibited from becoming excessively low. Furthermore, the fusing portion is inhibited from deforming with the passage of the lighting time of the discharge lamp.

Still furthermore, it is preferable in the first discharge lamp that the outer tube contains 90 to 99.88 wt. % of silicon dioxide.

In order to achieve the above-mentioned object, a second discharge lamp of the present invention comprises an arc tube having a light-emitting portion provided with a pair of electrodes, and an outer tube enveloping the light-emitting portion and being at least partly fused to the arc tube. Herein, the outer tube contains silicon dioxide as a main component and further contains at least one selected from aluminum and zirconium together with boron. With such a structure, since the softening temperature of the outer tube can be lowered and the processing temperature when the arc tube and the outer tube are fused can be lowered, the deformation of the arc tube can be inhibited.

It is preferable in the second discharge lamp that the expression: $(w_B+2w_{Al}+5w_{Zr}) \leqq 0.12$ is satisfied, wherein $w_B$ [wt. %] is the content of boron, $w_{Al}$, [wt. %] is the content of aluminum and $w_{Zr}$ [wt. %] is the content of zirconium in the outer tube.

Furthermore, it is preferable in the second discharge lamp that the expression: $(w_B+2w_{Al}+5w_{Zr})/D \leqq 120$ is satisfied, wherein $w_B$ [wt. %] is the content of boron, $w_{Al}$ [wt. %] is the content of aluminum, $w_{Zr}$[wt. %] is the content of zirconium in the outer tube, and D [mm] is the shortest distance between the inner surface of the outer tube and the external surface of the light-emitting portion. Thus, the outer tube can be inhibited from deforming with the passage of the lighting time of the discharge lamp.

Still furthermore, it is preferable in the second discharge lamp that the expression: $(w_B+2w_{Al}+5w_{Zr})/L \leqq 1.2$ is satisfied, wherein $w_B$[wt. %] is the content of boron, $w_{Al}$ [wt. %] is the content of aluminum, $w_{Zr}$ [wt. %] is the content of zirconium it the outer tube, and L [mm] is the shortest distance between the tip of the electrode located in the light-emitting portion and the portion where the outer tube and the arc tube are fused to each other. Thus, the fused portion can be inhibited from deforming with the passage of the lighting time of the discharge lamp.

Still furthermore, it is preferable in the second discharge lamp that the outer tube contains 90 to 99.88 wt. % of silicon dioxide.

It is preferable in the first and second discharge lamps that the outer tube contains no more than 0.1 wt. % of at least one element selected from the group consisting of lithium, sodium, potassium, rubidium, cesium, beryllium, magnesium, calcium, strontium and barium.

Furthermore, it is preferable in the first and second discharge lamps that the outer tube further comprises at least one element selected from the group consisting of cerium, titanium, iron, praseodymium and europium. Thus, ultraviolet rays radiated from the discharge lamp can be reduced. Moreover, it is preferable that the content of the above-mentioned element in the outer tube is 0.01 to 1 wt. %.

Still further, it is preferable in the first and second discharge lamps that the expression: $P/D \leqq 2000$ is satisfied, wherein P [W] is an electric power supplied to the discharge lamp and D [mm] is the shortest distance between the inner surface of the outer tube and the external surface of the light-emitting portion. Thus, the deformation of the outer tube due to the temperature increase in the outer tube during the lighting operation of the discharge lamp can be inhibited.

DETAILED DESCRIPTION OF THE INVENTION

Figure 1:
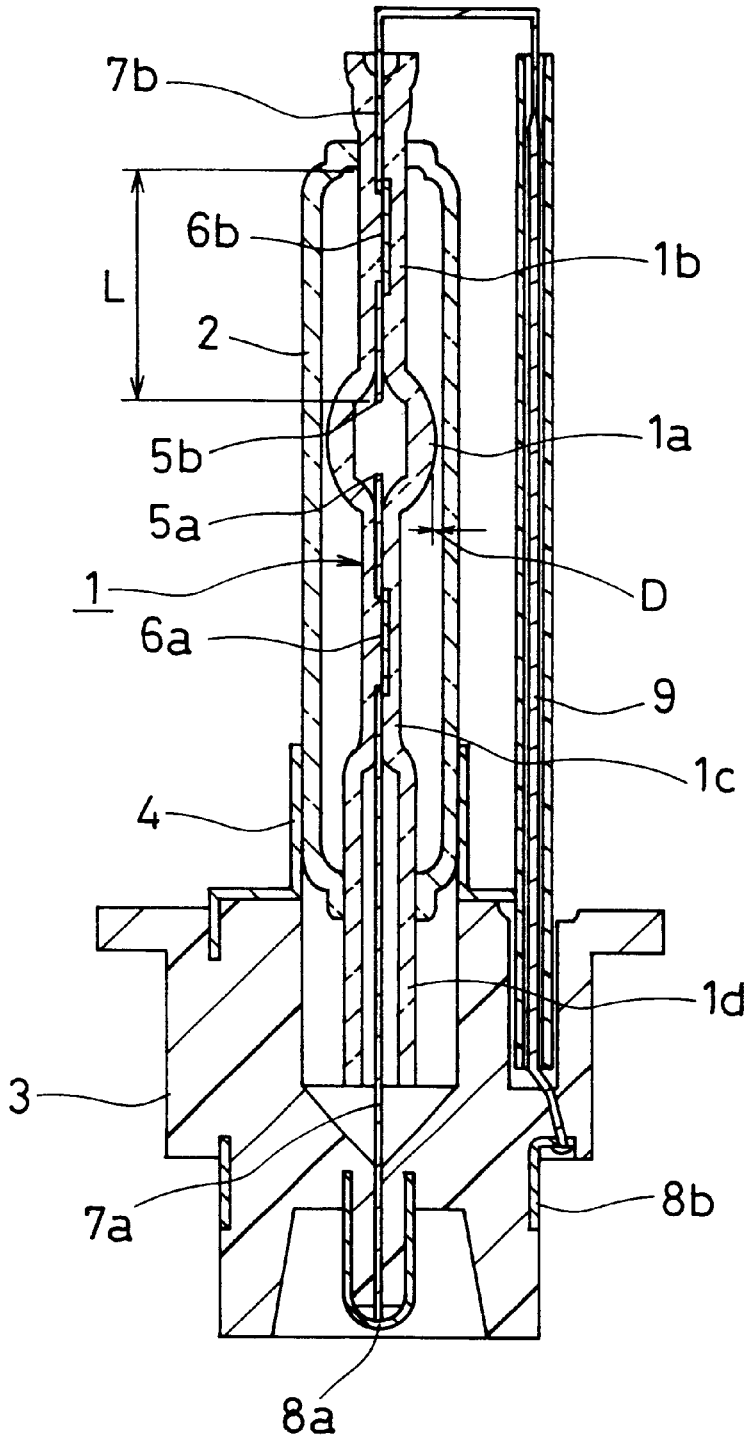
FIG. 1 is a cross-sectional view showing a structure of a discharge lamp of one example of the present invention.

Hereinafter, the present invention will be described by way of Examples with reference to the drawing.

FIG. 1 is a cross-sectional view showing a discharge lamp according to one example of the present invention.

An arc tube 1 comprises a spherical tubular light-emitting portion 1*a* forming a discharge space, flat sealing portions 1*b* and 1*c* that seal the both ends of the light-emitting portion 1*a* and a cylindrical side tube portion 1*d* provided continuously with the sealing portion 1*c*. The light-emitting portion 1*a* is provided with a pair of electrodes 5*a* and 5*b* and filled with mercury, metal halide and inert gas. One end of the electrode 5*a* is placed in the light-emitting portion 1*a*, and another end is connected to an outer lead wire 7*a* via a metal foil 6*a* embedded in the sealing portion 1*c*. Similarly, one end of the electrode 5*b* is placed in the light-emitting portion 1*a* and another end is connected to an outer lead wire 7*b* via a metal foil 6*b* embedded in the sealing portion 1*b*.

An outer tube 2 has an inner diameter that is larger than that of the light-emitting portion 1*a*. The arc tube 1 is inserted in the outer tube 2. The ends of the outer tube 2 are fused to the sealing portion 1*b* and the side tube portion 1*d*, respectively. In other words, the outer tube 2 is joined to the arc tube 1 so that it envelops the light-emitting portion 1*a*.

Furthermore, the arc tube 1 fused to the outer tube 2 is inserted into the concave portion formed in a base 3 and fixed with a support 4. Furthermore, the outer lead wire 7*a* is connected to a connection terminal 8*a* formed in the base 3, and the outer lead wire 7*b* is connected to a connection terminal 8*b* via a power supply line 9.

The arc tube 1 is made of silica glass. The softening temperature of the silica glass constituting the arc tube 1 is preferably 1600 to 1700° C., more preferably 1650 to 1700° C. The silica glass constituting the arc tube 1 preferably contains 90 wt. % or more of silicon dioxide, more preferably 95 wt. % or more, further preferably 98 wt. % or more. In addition, the silica glass may contain various kinds of elements as additives and impurities as long as the softening temperature of the glass is not excessively reduced and the glass is not devitrified with respect to visible light.

The outer tube 2 is made of silica glass. The silica glass constituting the outer tube 2 preferably contains silicon dioxide in the range from 90 to 99.88 wt. %, more preferably 95 to 99.8 wt. %, further preferably 97 to 99.5 wt. %.

The silica glass constituting the outer tube 2 has a softening temperature that is sufficiently lower than that of the silica glass constituting the arc tube 1. The softening temperature of the silica glass constituting the outer tube 2 is lower than that constituting the arc tube 1 preferably by 50° C. or more, more preferably by 100° C. or more. Specifically, the softening temperature is preferably 1650° C. or less, more preferably 1600° C. or less, and further preferably 1550° C. or less.

In order to achieve the above-mentioned softening temperature, the silica glass constituting the outer tube 2 contains additives capable of reducing the softening temperature. As such additives, at least one element selected from the group consisting of boron, aluminum and zirconium can be used. In particular, it is preferable that boron is used alone or in combination with at least one of aluminum and zirconium.

The greater the amount of the above-mentioned additives, the more the softening temperature of the silica glass can be lowered. Therefore, the lower limit of the content of the additives is specified as the amount capable of achieving the above-mentioned softening temperature. When boron is used alone as the additive, the content ($w_B$ wt. %) is preferably 0.12 wt. % or more, more preferably 0.3 wt. % or more. On the other hand, when the boron is used in combination with at least one of aluminum and zirconium as the additives, the content of the additives preferably satisfies the expression: $(w_B+2w_{Al}+5w_{Zr})\geqq 0.12$, more preferably the expression: $(w_B+2w_{Al}+5w_{Zr})\geqq 0.3$. Herein, $w_{Al}$ [wt. %] and $w_{Zr}$ [wt. %] represent the contents of aluminum and zirconium, respectively.

Furthermore, it is preferable that the softening temperature of the silica glass constituting the outer tube 2 is sufficiently higher than the temperature the outer tube 2 reaches during the lighting operation of the discharge lamp. When the discharge lamp lights up, the light-emitting portion 1*a* is heated by the heat generated by the electrodes 5*a* and 5*b*, subsequently the outer tube 2 is heated by the heat from the light-emitting portion 1*a*. Furthermore, the portion where the outer tube 2 and the arc tube 1 are fused to each other is heated by a heat conducted from the electrodes via a metal foil and the outer lead wire. Therefore, the temperature that the outer tube 2 reaches during the lighting operation of the discharge lamp depends upon the distance between the outer tube 2 and the light-emitting portion 1*a*, and the distance between the portion where the outer tube 2 and the arc tube 1 are fused to each other and the electrode.

Therefore, the softening temperature of the silica glass constituting the outer tube 2 can be determined by the distance between the outer tube 2 and the light-emitting portion 1*a*, more specifically by the shortest distance D [mm] between the inner surface of the outer tube 2 and the external surface of the light-emitting portion 1*a*. Moreover, D depends on an electric power P [W] that is supplied to the discharge lamp. Preferably, D is set so that the expression: $P/D\leqq 2000$ is satisfied. For example, in a 35 W lamp, D is usually 0.05 to 2 mm, preferably 0.1 to 2 mm.

Furthermore, the softening temperature can be determined by the distance between the portion where the outer tube 2 and the arc tube 1 are fused to each other and the electrode, more specifically the shortest distance L [mm] between the portion where the outer tube 2 and the arc tube 1 are fused to each other and the tip of the electrode located in the light-emitting portion 1*a*. Herein, L means the shortest distance among $L_1$ and $L_2$. $L_1$ is a distance between the tip of the electrode 5*a* located in the light-emitting portion 1*a*and the portion where the inner surface of the outer tube 2 is in contact with the light-emitting portion 1*a*. $L_2$ is a distance between the tip of the electrode 5*b* located in the light-emitting portion 1*a* and the portion where the inner surface of the outer tube 2 is in contact with the light-emitting portion 1*a*. Moreover, $L_1$ and $L_2$ may be the same or different from each other. Furthermore, L is set based on the electric power supplied to the discharge lamp. For example, in a 35 W lamp, L is usually 3 to 5 mm, preferably 3.8 to 4.6 mm.

For example, in the case of a 35 W lamp, the softening temperature of the silica glass constituting the outer tube 2 is 1400° C. or more, and more preferably 1450° C. or more.

Therefore, the upper limit of the content of the above-mentioned additives can be specified by the distance between the outer tube 2 and the light-emitting portion 1*a*. When boron is used alone as the additive, the content of boron ($w_B$wt. %) preferably satisfies the expression: $w_B/D \leqq 120$, more preferably $w_B/D \leqq 100$. Moreover, when boron is used in combination with at least one of aluminum and zirconium as the additives, the contents of the elements preferably satisfy the expression: $(w_B+2w_{Al}+5w_{Zr})/D \leqq 120$, more preferably the expression: $(w_B+2w_{Al}+5w_{Zr})/D \leqq 100$.

Furthermore, the upper limit of the content of the above-mentioned additives also can be specified by the distance between the portion where the outer tube 2 and the arc tube 1 are fused to each other and the electrode. When boron is used alone as the additive, the content of boron ($w_B$ wt. %) preferably satisfies the expression: $w_B/L \leqq 1.2$, more preferably $w_B/L \leqq 0.8$. Moreover, when boron is used in combination with at least one of aluminum and zirconium as the additives, the contents of the elements preferably satisfy the expression: $(w_B+2w_{Al}+5w_{Zr})/L \leqq 1.2$, more preferably the expression: $(w_B+2w_{Al}+5w_{Zr})/L \leqq 0.8$.

The content of boron in the silica glass constituting the outer tube 2 is preferably 0.04 to 2.0 wt. %, more preferably 0.1 to 1.8 wt. %, further preferably 0.5 to 1.5 wt. %. Moreover, the content of aluminum is preferably 0.02 to 1.0 wt. %, more preferably 0.05 to 0.8 wt. %, further preferably 0.05 to 0.5 wt. %. Moreover, the content of the zirconium is preferably 0.008 to 0.4 wt. %, more preferably 0.008 to 0.3 wt. %, further preferably in the range from 0.008 to 0.2 wt. %.

Moreover, the silica glass constituting the outer tube 2 preferably contains an element that absorbs ultraviolet rays. As such an element, at least one element selected from the group consisting of cerium, titanium, iron, praseodymium and europium can be used. The content of such an element is preferably 0.01 to 1 wt. %, more preferably 0.1 to 1.0 wt. %, and further preferably 0.2 to 0.8 wt. %.

Furthermore, the silica glass constituting the outer tube 2 may contain the other elements as additives and impurities. Examples of such elements include an alkaline metal such as lithium, sodium, potassium, rubidium, cesium, and the like, and an alkaline earth metal such as beryllium, magnesium, calcium, strontium, barium, and the like. However, the contents of the alkaline metal and alkaline earth metal are preferably 0.1 wt. % or less, more preferably 0.05 wt. % or less, and further preferably 0.03 wt. % or less, because too large a content of them may lead to the devtrification of the outer tube 2.

In the discharge lamp of the present invention, although the ultraviolet radiant quantity ($k_{UV}$) is not particularly limited, however, it is preferably $2.0\times10^{-5}$ W/lm or less, more preferably $1.0\times10^{-5}$ W/lm or less. Herein, the ultraviolet radiant quantity ($k_{UV}$) denotes a value expressed by the following equation:

$$k_{uv} = \frac{\int_{\lambda=250\,\mathrm{nm}}^{400\,\mathrm{nm}} E_e(\lambda)\cdot S(\lambda)\cdot d\lambda}{k_m \int_{\lambda=250\,\mathrm{nm}}^{400\,\mathrm{nm}} E_e(\lambda)\cdot v(\lambda)\cdot d\lambda}$$

$E_e(\lambda)$: spectral distribution of radiant flux [W]

$v(\lambda)$: spectral luminous efficacy [1]

$\lambda$: wavelength [nm]

$S(\lambda)$: spectral load function [1]

$k_m$: optical radiant equivalent (=683[lm/W])

Furthermore, the total luminous flux at the initial period of lighting operation of the lamp is preferably 2900 lm or more, more preferably 3000 lm or more. Furthermore, the luminous flux maintenance factor after 1000 hours of lighting operation is preferably 70% or more, more preferably 75% or more.

Furthermore, in the discharge lamp of the present invention, the general color rendering index (Ra) is preferably 60 or more, more preferably 65 or more.

In order to obtain such properties, it is preferable in the discharge lamp of the present invention that a mixture of sodium halide (NaX) and scandium halide ($ScX_3$) is used as the metal halide to be sealed in the light-emitting portion 1*a*. Furthermore, in this case, the weight ratio of NaX and $ScX_3$ is preferably in the range: $1<NaX/ScX_3<20$. Moreover, as the halide (X), I and Br preferably are used. Furthermore, as the inert gas, for example, xenon is preferably used.

Example 1

As shown in Table 1, sixteen types of outer tubes (Nos. 1 to 16) were produced by variously changing the contents of boron ($w_B$), aluminum ($w_{Al}$) and zirconium ($w_{Zr}$). Moreover, the outer tubes Nos. 1 to 16 contained 90 wt. % or more of silicon dioxide.

Discharge lamps having the same structure as FIG. 1 were produced by using the above-produced outer tubes. Silica glass containing 99.98 wt. % silicon dioxide and having a softening temperature of 1683° C. was used for an arc tube. 16 mg of NaI, 4 mg of $ScI_3$, 50mg of mercury and 7 atm of xenon gas were filled in the light-emitting portion. Moreover, the light-emitting portion had a content volume of 0.025 cc and an arc length of 4.2 mm.

The arc tube was inserted into the outer tube, and then the outer tube and the arc tube were fused to each other, thus forming a discharge lamp. The fusing temperature was as low as possible in the range capable of softening the outer tube to be used. The produced discharge lamps were visually observed for the deformation of the arc tube. The results are shown in Table 1. In Table 1, A indicates that the arc tube was not deformed; B indicates that the arc tube was slightly deformed; and C indicates that the arc tube is greatly deformed.

TABLE 1

| Outer tube | Content of additives in the outer tube [wt. %] | | | | Deformation of the arc |
|---|---|---|---|---|---|
| No. | $w_B$ | $w_{Al}$ | $W_{Zr}$ | $W_B + 2w_{Al} + 5w_{Zr}$ | tube |
| 1 | 0.12 | 0 | 0 | 0.12 | A |
| 2 | 3.00 | 0 | 0 | 3.00 | A |
| 3 | 0.08 | 0.02 | 0 | 0.12 | A |
| 4 | 0.04 | 0.05 | 0 | 0.14 | A |
| 5 | 3.00 | 1.00 | 0 | 5.00 | A |
| 6 | 0.07 | 0 | 0.01 | 0.12 | A |
| 7 | 7.00 | 0 | 1.00 | 12.00 | A |
| 8 | 0.05 | 0.01 | 0.01 | 0.12 | A |
| 9 | 0.90 | 0.10 | 0.10 | 1.60 | A |
| 10 | 0.94 | 0.26 | 0.07 | 1.81 | A |
| 11 | 2.96 | 0.45 | 0.32 | 5.46 | A |
| 12 | 5.00 | 1.00 | 1.00 | 12.00 | A |
| 13 | 0.01 | 0 | 0 | 0.10 | B |
| 14 | 0.05 | 0.02 | 0 | 0.09 | B |
| 15 | 0.05 | 0 | 0.01 | 0.10 | B |
| 16 | 0 | 0 | 0 | 0 | C |

As shown in Table 1, when the outer tubes Nos. 1 to 12 were used, the arc tubes were not deformed. When the outer tubes Nos. 13 to 15 were used, the arc tubes were slightly deformed. On the other hand, when the outer tube No. 16 without containing boron, aluminum or zirconium was used, the arc tube was greatly deformed.

Example 2

Discharge lamps were produced using the same arc tubes and outer tubes (Nos. 1 to 16) as Example 1 and by changing the distance between the inner face of the outer tube and the outer face of the arc tube (the distance shown by D in FIG. 1). The thus produced discharge lamps were observed visually for the deformation of the outer tube after 1000 hours of lighting operation with 35 W electric power. The results are shown in Table 2. In Table 2, A indicates that the outer tube was not deformed, and B indicates that the outer tube was deformed.

TABLE 2

| Outer tube | Distance between the outer tube and the arc tube D [mm] | | | |
|---|---|---|---|---|
| No. | 0.01 | 0.02 | 0.05 | 0.10 |
| 1 | A | A | A | A |
| 2 | B | B | A | A |
| 3 | A | A | A | A |
| 4 | A | A | A | A |
| 5 | B | B | A | A |
| 6 | A | A | A | A |
| 7 | B | B | B | A |
| 8 | A | A | A | A |
| 9 | B | A | A | A |
| 10 | B | A | A | A |
| 11 | B | B | A | A |
| 12 | B | B | B | A |
| 13 | A | A | A | A |
| 14 | A | A | A | A |
| 15 | A | A | A | A |
| 16 | A | A | A | A |

As shown in Table 2, when $(w_B+2w_{Al}+5w_{Zr})/D \leqq 120$ was satisfied, the deformation of the outer tube was not observed. On the other hand, when $(w_B+2w_{Al}+5w_{Zr})/D>120$ was satisfied, the deformation of the outer tube was observed.

Example3

Discharge lamps were produced by using the same arc tubes and the outer tubes (Nos. 1 to 16) as Example 1 and by changing the shortest distance between the tip of the electrode and the fused portion of the arc tube and the outer tube (the distance shown by L in FIG. 1). The produced discharge lamps were observed visually for the deformation of the outer tube after 1000 hours of lighting operation with 35 W electric power. The results are shown in Table 3. In Table 3, A indicates that the fused portion was not deformed and B indicates that the fused portion was deformed.

TABLE 3

| Outer tube | Distance between the fused portion of the outer tube and the arc tube and the electrode L [mm] | | | |
|---|---|---|---|---|
| No. | 0.1 | 1.0 | 0.5 | 10.0 |
| 1 | A | A | A | A |
| 2 | B | B | B | A |
| 3 | A | A | A | A |
| 4 | B | A | A | A |
| 5 | B | B | B | A |

TABLE 3-continued

| Outer tube | Distance between the fused portion of the outer tube and the arc tube and the electrode L [mm] | | | |
|---|---|---|---|---|
| No. | 0.1 | 1.0 | 0.5 | 10.0 |
| 6 | A | A | A | A |
| 7 | B | B | B | A |
| 8 | A | A | A | A |
| 9 | B | B | A | A |
| 10 | B | B | A | A |
| 11 | B | B | B | A |
| 12 | B | B | B | A |
| 13 | A | A | A | A |
| 14 | A | A | A | A |
| 15 | A | A | A | A |
| 16 | A | A | A | A |

As shown in Table 3, when the expression: $(w_B+2w_{Al}+5w_{Zr})/L \leqq 1.2$ is satisfied, the deformation was not observed in the fused portion of the outer tube and the arc tube. On the other hand, when the expression: $(w_B+2w_{Al}+5w_{Zr})/L>1.2$ is satisfied, the deformation was observed in the fused portion.

Example 4

Seven types of outer tubes (Nos. 17 to 23) were produced by using silica glass containing boron, aluminum and zirconium and by variously changing the contents of potassium ($w_k$) and barium ($w_{Ba}$), as shown in Table 4. Moreover, the outer tubes (No. 17 to 23) contained 90 wt. % or more of silicon dioxide.

By using the thus produced outer tubes, discharge lamps having the same structure as FIG. 1 were produced. As the arc tube, the same arc tube as Example 1 was used. The arc tube was inserted into the outer tube, and then the outer tube and the arc tube were fused to each other, thus forming a discharge lamp. The fusing temperature was made to be as low as possible in the range capable of softening the outer tube to be used. The produced discharge lamps were observed visually for devitrification of the outer tubes after 1000 hours of lighting operation with 35 W electric power. The results are shown in Table 4. In Table 4, A indicates that the devitrification of the outer tube was not observed and B indicates that the devitrification of the outer tube was observed.

TABLE 4

| Outer tube | Content of additives in the outer tube [wt. %] | | | | | Devitrification of the outer |
|---|---|---|---|---|---|---|
| No. | $w_B$ | $w_{Al}$ | $w_{Zr}$ | $w_K$ | $w_{Ba}$ | tube |
| 17 | 1.00 | 0.30 | 0.07 | 0 | 0 | A |
| 18 | 1.00 | 0.30 | 0.07 | 0.10 | 0 | A |
| 19 | 1.00 | 0.30 | 0.07 | 0 | 0.10 | A |
| 20 | 1.00 | 0.30 | 0.07 | 0.02 | 0.08 | A |
| 21 | 1.00 | 0.30 | 0.07 | 0.12 | 0 | B |
| 22 | 1.00 | 0.30 | 0.07 | 0 | 0.15 | B |
| 23 | 1.00 | 0.30 | 0.07 | 0.08 | 0.04 | B |

As shown in Table 4, when the outer tubes Nos. 17 to 20 were used, the devitrification of the outer tubes were not observed. On the other hand, when the outer tubes No. 21 to 23 were used, the devitrification of the outer tube was observed.

Example 5

Fourteen types of outer tubes (Nos. 24 to 37) were produced by using silica glass containing boron, aluminum and zirconium and by variously changing the contents of cerium ($w_{Ce}$), titanium ($w_{Ti}$), iron ($w_{Fe}$), praseodymium ($w_{Pr}$) and europium ($w_{Eu}$), as shown in Table 5. Moreover, the outer tubes No. 24 to 37 contained 90 wt. % or more of silicon dioxide.

By using the thus produced outer tubes, discharge lamps having the same structure as FIG. 1 were produced. As the arc tube, the same arc tube as Example 1 was used. The arc tube was inserted into the outer tube, and then the outer tube and arc tube were fused to each other, thus forming a discharge lamp. When the produced discharge lamps were lighted up with 35 W electric power, ultraviolet rays radiant quantities ($k_{UV}$) and the total luminous flux at the initial period of lighting operation were examined. The results are shown in Table 5.

TABLE 5

| Outer | Content of additives in the outer tube [wt. %] | | | | | | | | $K_{UV}$ | Total luminous |
|---|---|---|---|---|---|---|---|---|---|---|
| tube No | $w_B$ | $w_{Al}$ | $w_{Zr}$ | $w_{Ce}$ | $w_{Ti}$ | $w_{Fe}$ | $w_{Pr}$ | $w_{Eu}$ | [$10^{-5}$ W/lm] | flux [lm] |
| 24 | 0.90 | 0.20 | 0.01 | 0.01 | 0 | 0 | 0 | 0 | 1.98 | 3250 |
| 25 | 0.90 | 0.20 | 0.01 | 0 | 0.01 | 0 | 0 | 0 | 1.85 | 3240 |
| 26 | 0.90 | 0.20 | 0.01 | 0 | 0 | 0.01 | 0 | 0 | 1.95 | 3270 |
| 27 | 0.90 | 0.20 | 0.01 | 0 | 0 | 0 | 0.01 | 0 | 1.76 | 3240 |
| 28 | 0.90 | 0.20 | 0.01 | 0 | 0 | 0 | 0 | 0.01 | 1.88 | 3260 |
| 29 | 0.90 | 0.20 | 0.01 | 1.00 | 0 | 0 | 0 | 0 | 0.07 | 3100 |
| 30 | 0.90 | 0.20 | 0.01 | 0 | 1.00 | 0 | 0 | 0 | 0.11 | 3080 |
| 31 | 0.90 | 0.20 | 0.01 | 0 | 0 | 1.00 | 0 | 0 | 0.03 | 3010 |
| 32 | 0.90 | 0.20 | 0.01 | 0 | 0 | 0 | 1.00 | 0 | 0.11 | 3040 |
| 33 | 0.90 | 0.20 | 0.01 | 0 | 0 | 0 | 0 | 1.00 | 0.23 | 3030 |
| 34 | 0.90 | 0.20 | 0.01 | 3.00 | 0 | 0 | 0 | 0 | 0.03 | 2840 |
| 35 | 0.90 | 0.20 | 0.01 | 0 | 3.00 | 0 | 0 | 0 | 0.04 | 2860 |
| 36 | 0.90 | 0.20 | 0.01 | 0 | 0 | 3.00 | 0 | 0 | 0.02 | 2760 |
| 37 | 0.90 | 0.20 | 0.01 | 0 | 0 | 0 | 0 | 0 | 2.25 | 3260 |

As shown in Table 5, when the outer tubes Nos. 24 to 36 containing cerium, titanium, iron, praseodymium or europium were used, $k_{UV}$ was lower by about 10% or more than the case where the outer tube No. 37 without containing the above-mentioned elements was used. Furthermore, when the outer tubes Nos. 24 to 33 containing less than 1 wt. % of cerium, titanium, iron, praseodymium and europium were used, high total luminous flux could be obtained.

The invention may be embodied in other specific forms without departing from the spirit or essential characteristics thereof The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A discharge lamp comprising:

an arc tube having a light-emitting portion provided with a pair of electrodes and an outer tube envelope enveloping said light-emitting portion and being at least partly fused to said arc tube, wherein at least a portion of said outer tube that is fused to said arc tube comprises silicon dioxide as a main component and further comprises boron, said outer tube comprising at least 0.12 wt. % of boron, and the lamp satisfies the relationship $w_B$ (wt. %)/D (mm) $\leqq 120$, wherein $w_B$ is the content of boron in said outer tube and D is the shortest distance between an inner surface of said outer tube and an external surface of said light-emitting portion.

2. The discharge lamp according to claim 1, wherein said outer tube comprises 90 to 99.88 wt. % of silicon dioxide.

3. The discharge lamp according to claim 1, wherein said outer tube further comprises no more than 0.1 wt. % of at least one element selected from the group consisting of lithium, sodium, potassium, rubidium, cesium, beryllium, magnesium, calcium, strontium and barium.

4. The discharge lamp according to claim 1, wherein the lamp satisfies the relationship P (W)/D (mm)$\leqq$2000, wherein P is an electric power supplied to said discharge lamp and D is the shortest distance between an inner surface of said outer tube and an external surface of said light-emitting portion.

5. The discharge lamp according to claim 1, wherein said outer tube further comprises at least one element selected from the group consisting of cerium, titanium, iron, praseodymium and europium.

6. The discharge lamp according to claim 5, wherein the content of at least one element selected from the group consisting of cerium, titanium, iron, praseodymium and europium in said outer tube is 0.01 to 1 wt. %.

7. A discharge lamp comprising:

an arc tube having a light-emitting portion provided with a pair of electrodes and an outer tube enveloping said light-emitting portion and being at least partly fused to said arc tube, wherein at least a portion of said outer tube that is fused to said arc tube comprises silicon dioxide as a main component and further comprises at least one selected from aluminum and zirconium together with boron, and the lamp satisfies the relationships $W_B$ (wt. %)+2$w_{Al}$ (wt. %)+5$w_{Zr}$(wt. %)$\geqq$0.12 and ($W_B$ (wt. %)+2$w_{Al}$ (wt. %)+5$w_{Zr}$ (wt. %))/D$\geqq$120 wherein $w_B$ is the content of boron, $w_{Al}$ is the content of aluminum $w_{Zr}$ is the content of zirconium in said outer tube, and D is the shortest distance between an inner surface of said outer tube and an external surface of said light-emitting portion.

8. The discharge lamp according to claim 7, wherein said outer tube comprises 90 to 99.88 wt. % of silicon dioxide.

9. The discharge lamp according to claim 7, wherein said outer tube comprises no more than 0.1 wt. % of at least one element selected from the group consisting of lithium, sodium, potassium, rubidium, cesium, beryllium, magnesium, calcium, strontium and barium.

10. The discharge lamp according to claim 1, wherein the lamp satisfies the relationship P (W)/D (mm)$\leqq$2000, wherein P is an electric power supplied to said discharge lamp and D is the shortest distance between an inner surface of said outer tube and an external surface of said light-emitting portion.

11. The discharge lamp according to claim 7, wherein said outer tube further comprises at least one element selected from the group consisting of cerium, titanium, iron, praseodymium and europium.

12. The discharge lamp according to claim 11, wherein the content of at least one element selected from the group consisting of cerium, titanium, iron, praseodymium and europium in said outer tube is 0.01 to 1 wt. %.

13. A discharge lamp comprising an arc tube having a light-emitting portion provided with a pair of electrodes and an outer tube envelope enveloping said light-emitting portion and being at least partly fused to said arc tube, wherein at least a portion of said outer tube that is fused to said arc tube comprises silicon dioxide as a main component and further comprises boron, said outer tube comprising at least 0.12 wt. % of boron and wherein the lamp satisfies the relationship $w_B$ (wt. %)/L (mm)≦1.2, where $w_B$ is the content of boron in said outer tube and L is the shortest distance between a tip of one of said electrodes located in said light-emitting portion and the portion where said outer tube and said arc tube are fused to each other.

14. The discharge lamp according to claim 13, wherein said outer tube comprises 90 to 99.88 wt. % of silicon dioxide.

15. The discharge lamp according to claim 13, wherein said outer tube further comprises no more than 0.1 wt. % of at least one element selected from the group consisting of lithium, sodium, potassium, rubidium, cesium, beryllium, magnesium, calcium, strontium and barium.

16. The discharge lamp according to claim 13, wherein said outer tube further comprises at least one element selected from the group consisting of cerium, titanium, iron, praseodymium and europium.

17. The discharge lamp according to claim 13, wherein the content of at least one element selected from the group consisting of cerium, titanium, iron, praseodymium and europium in said outer tube is 0.01 to 1 wt. %.

18. The discharge lamp according to claim 13, wherein the lamp satisfies the relationship P (W)/D (mm)≦2000, wherein P is an electric power supplied to said discharge lamp and D is the shortest distance between an inner surface of said outer tube and an external surface of said light-emitting portion.

19. A discharge lamp comprising an arc tube having a light-emitting portion provided with a pair of electrodes and an outer tube enveloping said light-emitting portion and being at least partly fused to said arc tube, wherein at least a portion of said outer tube that is fused to said arc tube comprises silicon dioxide as a main component and further comprises at least one selected from aluminum and zirconium together with boron, wherein the lamp satisfies the relationships $w_B$ (wt. %)+2$w_{Al}$ (wt. %)+5$w_{Zr}$(wt. %)≧0.12 and ($w_B$(wt. %)+2$w_{Al}$ (wt. %)+5$w_{Zr}$ (wt.%))/L≦1.2, wherein $w_B$ is the content of boron, $w_{Al}$ is the content of aluminum, $w_{Zr}$ is the content of zirconium in said outer tube, and L is the shortest distance between a tip of one of said electrodes located in said light-emitting portion and a portion where said outer tube and said arc tube are fused to each other.

20. The discharge lamp according to claim 19, wherein said outer tube comprises 90 to 99.88 wt. % of silicon dioxide.

21. The discharge lamp according to claim 19, wherein said outer tube comprises no more than 0.1 wt. % of at least one element selected from the group consisting of lithium, sodium, potassium, rubidium, cesium, beryllium, magnesium, calcium, strontium and barium.

22. The discharge lamp according to claim 19, wherein the lamp satisfies the relationship P (W)/D (mm)≦2000, wherein P is an electric power supplied to said discharge lamp and D is the shortest distance between an inner surface of said outer tube and an external surface of said light-emitting portion.

23. The discharge lamp according to claim 19, wherein said outer tube further comprises at least one element selected from the group consisting of cerium, titanium, iron, praseodymium and europium.

24. The discharge lamp according to claim 23, wherein the content of at least one element selected from the group consisting of cerium, titanium, iron, praseodymium and europium in said outer tube is 0.01 to 1 wt. %.

* * * * *